US005218981A

United States Patent [19]

Lai

[11] Patent Number: 5,218,981

[45] Date of Patent: Jun. 15, 1993

[54] CONSTRUCTION OF UMBRELLA COVER WITHOUT AXIS CONNECTIVE LINE

[76] Inventor: Chen Min Lai, F38, 3rd Floor, No. 5, Hsin I Road, Sec. 5, Taipei, Taiwan

[21] Appl. No.: 856,702

[22] Filed: Mar. 24, 1992

[51] Int. Cl.[5] ..... A45B 25/18

[52] U.S. Cl. ..... 135/33.2; 135/15.1

[58] Field of Search ..... 135/15.1, 33.2

[56] References Cited

U.S. PATENT DOCUMENTS

| | | | |
|---|---|---|---|
| 2,039,987 | 5/1936 | Goldman | 135/33.2 |
| 3,042,056 | 7/1962 | Todorovic | 135/33.2 |
| 3,557,809 | 1/1971 | Vazquez | 135/15.1 |
| 4,952,780 | 10/1990 | Engdahl et al. | 135/33.2 |
| 5,020,559 | 6/1991 | Lai | 135/33.2 |

*Primary Examiner*—Richard E. Chilcot, Jr.
*Assistant Examiner*—Lan M. Mai
*Attorney, Agent, or Firm*—Morton J. Rosenberg; David I. Klein

[57] ABSTRACT

An umbrella is provided devoid of an axis connecting line. The umbrella includes a primary blank member on which a pattern can be printed without consideration of the arrangement of the meshes and several triangular supplementary blank members attached about the periphery of the primary blank member. The meshes of the supplementary blank members are arranged to be perpendicular to or parallel to the outer periphery of the completed umbrella cover for providing structural integrity to the umbrella construction.

1 Claim, 5 Drawing Sheets

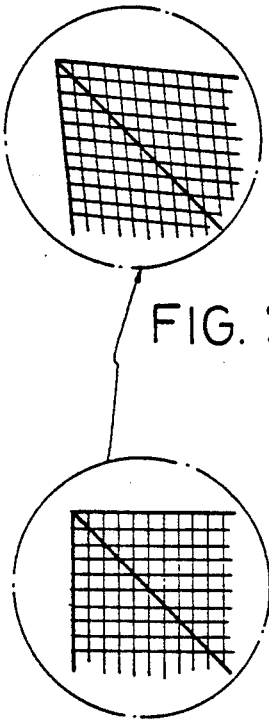
FIG. 2-3
FIG. 2-2
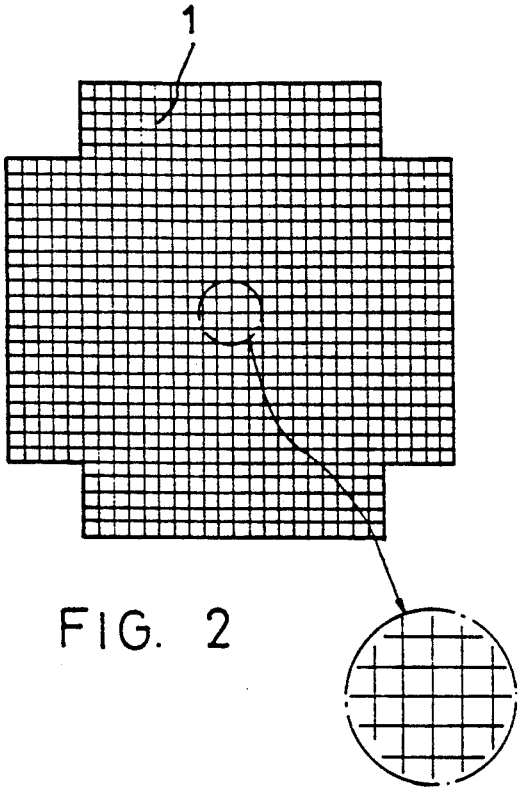
FIG. 2
FIG. 2-1
(prior art)

CONSTRUCTION OF UMBRELLA COVER WITHOUT AXIS CONNECTIVE LINE

BACKGROUND OF THE INVENTION

It has become the trend in manufacturing high quality umbrella covers to simplify the tailoring process, minimize labor costs, and provide one individual, continuous pattern on the cover cloth. As shown in FIG. 1, a conventional cover is comprised of a plurality of gores 8 corresponding in number to the number of umbrella ribs. Adjacent gores 8 are sewn together along their longest peripheries to form an umbrella cover with a plurality of stitching lines 81 corresponding in number to the number of umbrella ribs. The individual gores 8 prevent one continuous pattern from being printed in its entirety on the surface of the umbrella cover. Another prior art cover has been filed at the United States Patent and Trademark Office under U.S. patent application Ser. No. 07/275,065. As shown in FIG. 2, the umbrella cover of the aforementioned Patent Application is directed to an umbrella cover construction of non-axis connective line, the cover of which has parallel warped and weft construction for installing the cover on ribs spaced at unequal intervals.

There is still a need for an umbrella cover having a parallel warp and weft construction for umbrellas having ribs spaced apart each from the other in an equidistant manner.

SUMMARY OF THE INVENTION

It is the purpose of the invention to mitigate and/or obviate the above drawbacks in the manner set forth in the detailed Description of the Preferred Embodiment.

A primary objective of the present invention is to provide a new construction of an umbrella cover without an axis connective line which is stronger than prior art umbrella covers.

Another object of the present invention is to provide an umbrella cover having a primary blank member of unitary construction which may have a pattern in its entirety printed upon the surface of the primary blank member.

Further objects and advantages of the present invention will become apparent from the following detailed Description when considered in connection with the accompanying Drawings.

BRIEF DESCRIPTION OF THE DRAWINGS

FIG. 1-1 is a plan view of a unitarily formed prior art blank member;

FIG. 1-2 is a plan view of a triangularly shaped prior art blank member.

FIG. 2 is a plan view of a second prior art umbrella cover;

FIG. 2-1 is a plan view of a portion of an overall prior art blank member;

FIG. 2-2 is a plan view of longitudinal and transverse lines forming a prior art blank member positioned orthogonal each to the other;

FIG. 2-3 is a plan view of a prior art blank member showing longitudinal and transverse lines skewed each to the other;

FIG. 3 is a plan view of a first preferred embodiment in accordance with the present invention;

DETAILED DESCRIPTION OF THE PREFERRED EMBODIMENT

Figure 1:
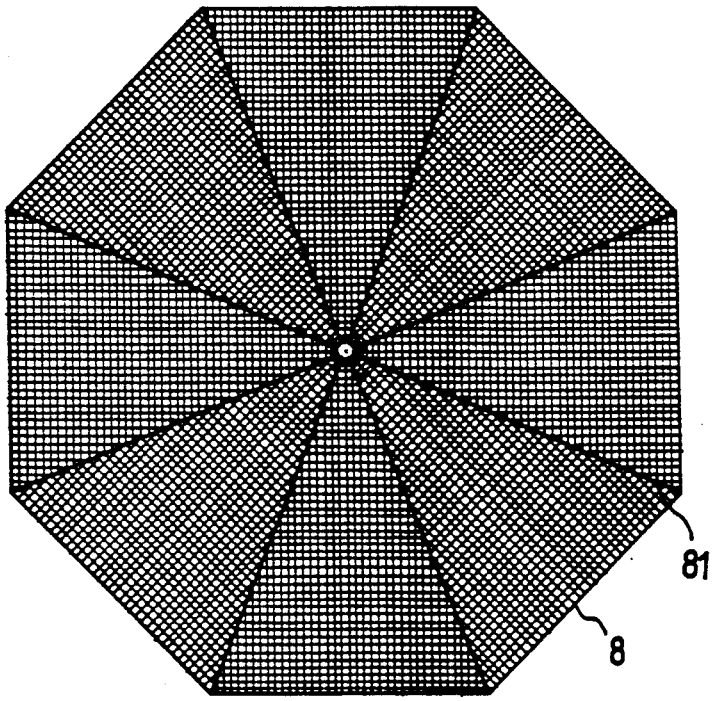
FIG. 1 is a plan view of a prior art umbrella cover.
Figures 1, 2:
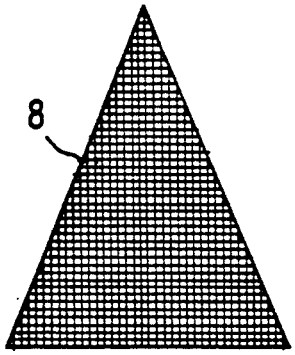
Figure 1:
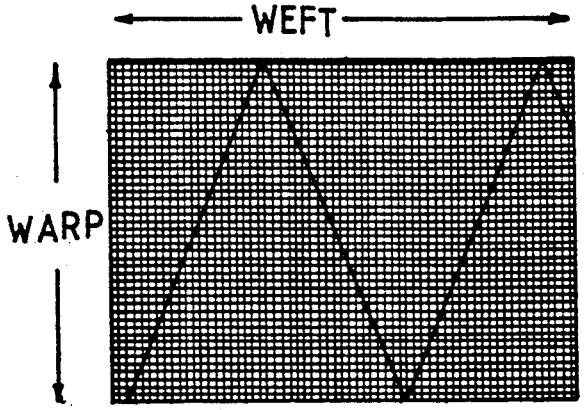
FIG. 1-1 (prior art)
Figure 3:
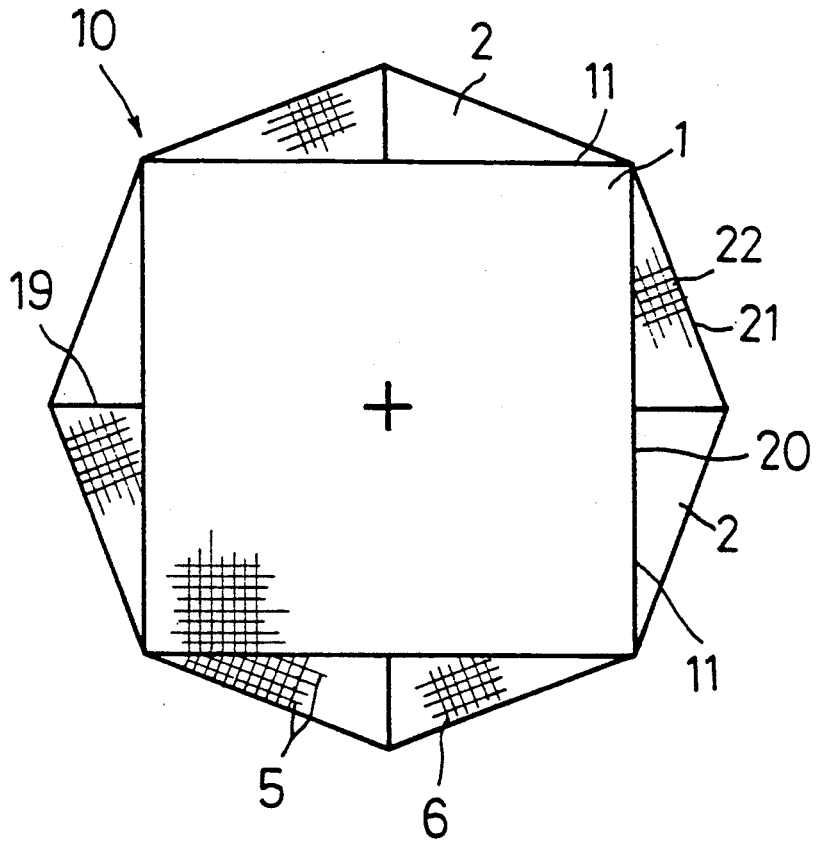

The present invention is an improvement of the umbrella cover of U.S. patent application Ser. No. 07/275,065. Referring to FIG. 3, a preferred structure of the present invention relates to an umbrella cover comprising a primary blank member 1, and a plurality of supplementary blank members 2 attached to the border or periphery 11 of the primary blank member 1. Each supplementary blank member 2 comprises three sides 19, 20 and 21, and a plurality of longitudinal and transverse lines 5 and 6, respectively, which are respectively parallel to and perpendicular to side 21 of the supplementary blank member 2. The longitudinal and transverse lines 5 and 6 of the supplementary blank members 2 form meshes 22. Side or edge 20 of each supplementary blank member 2 is attached to a portion of the periphery of border 11 of the primary cloth member 1. As shown in FIG. 3, the outer border or periphery of the completed umbrella cover 10 is arranged to be perpendicular to or parallel to the warps and wefts of the supplementary blank members 2. By attaching the supplementary blank members 2 to the primary blank member 1 in the above-described manner, the umbrella cover 10 can be manufactured by combining any desired primary blank member and supplementary blank members without considering the arranged meshes.

Figure 4:
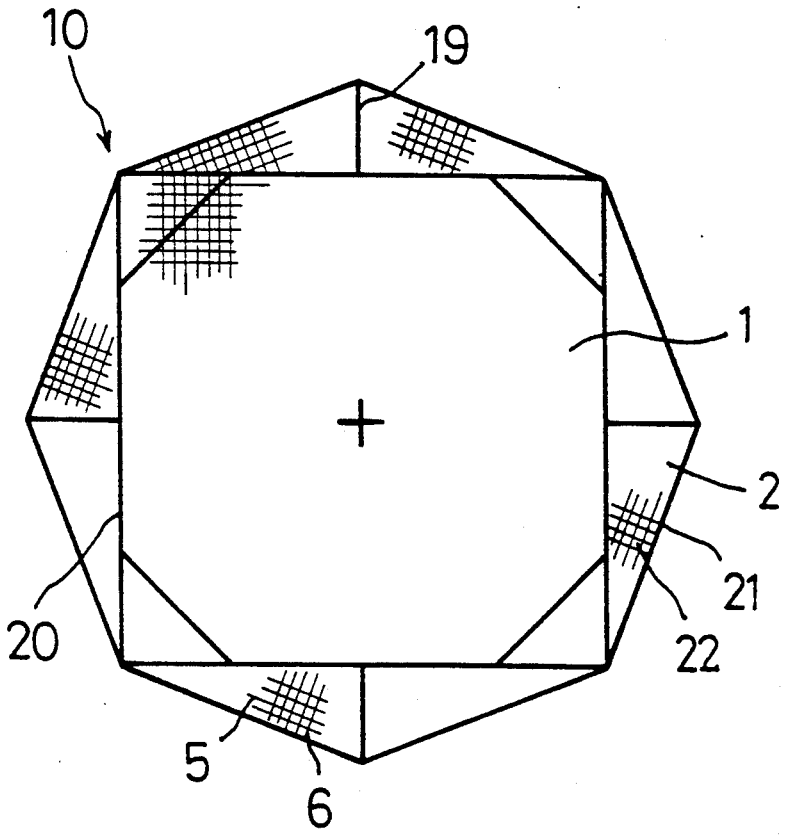
FIG. 4 is a plan view of a second preferred embodiment in accordance with the present invention; and, FIG. 5 is a plan view of a third preferred embodiment in accordance with the preferred invention.
Figure 5:
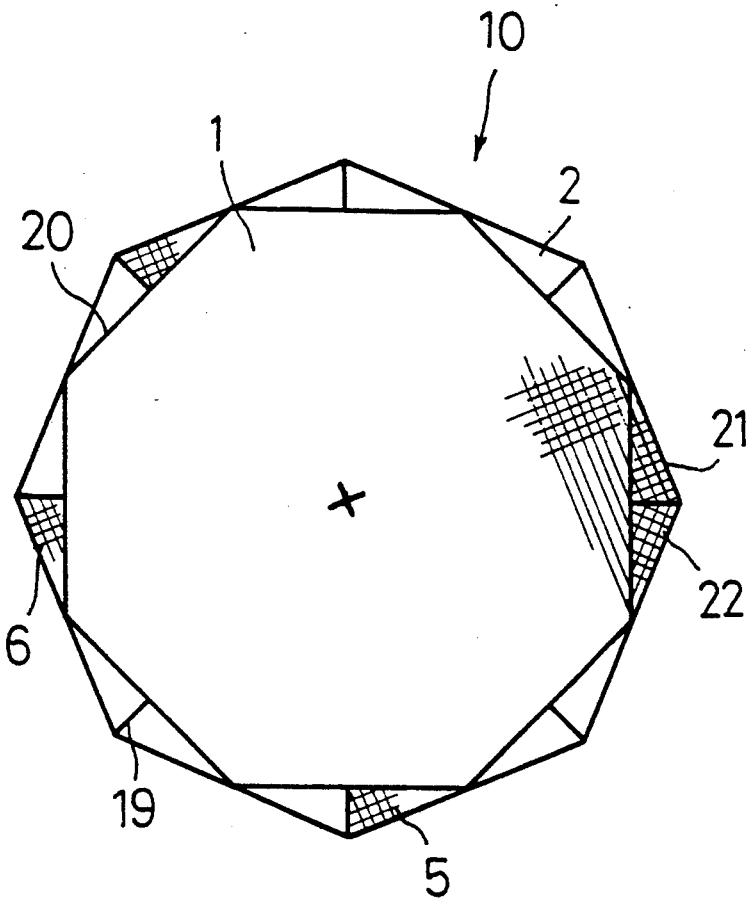

FIGS. 4 and 5 show two other embodiments of the present invention. Reference numerals of FIGS. 4 and 5 are the same as those used in FIG. 3 and denote similar elements of the umbrella cover 10. Each of the umbrella covers of FIGS. 4 and 5 contains a primary blank member 1 and a plurality of supplementary blank members 2 attached thereto, wherein the outer border or periphery of the complete umbrella covers are perpendicular to or parallel to the warps and wefts of the supplementary blank members 2. The umbrella covers of FIGS. 4 and 5 are constructed in a similar manner as the umbrella cover 10 shown in FIG. 3.

Although this invention has been described in connection with specific forms and embodiments thereof, it is to be understood that all matter herein described or shown in the accompanying Drawings is to be interpreted as illustrative and not in a limiting sense. Thus, it will be appreciated that the Drawings are exemplary of a preferred embodiment of the invention. Various modifications may be made without departing from the scope of the appended Claim.

I claim

1. An umbrella cover comprising:

a primary blank member of unitary construction; and, a plurality of triangularly contoured secondary blank members fixedly secured to and disposed throughout a periphery of said primary blank member, each said secondary blank member having a plurality of longitudinal and transverse wefts and warps extending parallel and perpendicular to an outer edge of said supplementary blank member, respectively, for increasing the structural integrity of said umbrella cover, wherein each outer edge of said supplementary blank member is an outer border of said umbrella cover.

* * * * *